United States Patent [19]

Yamazaki

[11] Patent Number: 4,716,089

[45] Date of Patent: Dec. 29, 1987

[54] PHOTOCONDUCTIVE MEMBER FOR EXHIBITING PHOTOCONDUCTIVITY UPON ILLUMINATION BY ELECTROMAGNETIC LIGHT IN THE VISIBLE TO ULTRAVIOLET RANGE

[75] Inventor: Mutsuki Yamazaki, Yokohama, Japan

[73] Assignee: Kabushiki Kaisha Toshiba, Kawasaki, Japan

[21] Appl. No.: 913,368

[22] Filed: Sep. 30, 1986

Related U.S. Application Data

[62] Division of Ser. No. 800,972, Nov. 22, 1985, abandoned.

[30] Foreign Application Priority Data

| | | | |
|---|---|---|---|
| Nov. 26, 1984 | [JP] | Japan | 59-248088 |
| Nov. 26, 1984 | [JP] | Japan | 59-248089 |
| Dec. 12, 1984 | [JP] | Japan | 59-262212 |
| Dec. 12, 1984 | [JP] | Japan | 59-262215 |
| Feb. 4, 1985 | [JP] | Japan | 60-19412 |
| Feb. 4, 1985 | [JP] | Japan | 60-19415 |

[51] Int. Cl.[4] ..... G03G 5/085

[52] U.S. Cl. ..... 430/57; 430/65; 430/67; 430/84

[58] Field of Search ..... 430/57, 58, 64, 65, 430/84, 67

[56] References Cited

U.S. PATENT DOCUMENTS 4,394,425 7/1983 Shimizu et al. .
4,510,224 4/1985 Yamazaki et al. ..... 430/84

*Primary Examiner*—John L. Goodrow
*Attorney, Agent, or Firm*—Schwartz, Jeffery, Schwaab, Mack, Blumenthal & Evans

[57] ABSTRACT

A blocking layer is formed of amorphous silicon carbide (a-Si:C) or amorphous silicon nitride (a-Si:N) on a conductive substrate. A first photoconductive layer formed of a-Si:C or a-Si:N on the blocking layer contains $1\times10^{-6}$ to $1\times10^{-3}$ atomic % of a Group III or V element in the Periodic Table. A second photoconductive layer formed of on the first photoconductive layer contains $1\times10^{-6}$ to $1\times10^{-3}$ atomic % of a Group III or V element. The second photoconductive layer has a thickness of 0.1 to 5 μm. With this multilayer structure, a photosensitive member having high charging and potential holding properties can be obtained.

5 Claims, 3 Drawing Figures

PHOTOCONDUCTIVE MEMBER FOR EXHIBITING PHOTOCONDUCTIVITY UPON ILLUMINATION BY ELECTROMAGNETIC LIGHT IN THE VISIBLE TO ULTRAVIOLET RANGE

This application is a division of application Ser. No. 800,972, filed Nov. 22, 1985, now abandoned.

BACKGROUND OF THE INVENTION

This invention relates to a photoconductive member which exhibits photoconductivity upon illumination with electromagnetic light in the infrared, visible, ultraviolet, X-ray, and $\gamma$-ray regions, and which facilitates formation of a latent electrostatic image.

In an image formation technique related to electrophotographic photosenstive members, solid-state imaging elements and the like, photoconductive members exhibiting photoconductivity are used. Such photoconductive members must have high resistivity in dark conditions (normally, $10^{13}$ $\Omega$·cm or higher) and low resistivity in bright conditions.

In an electrophotographic photosensitive member, electric charges are uniformly charged on a body surface by corona discharge. Then, light corresponding to an original pattern is radiated on the surface of the photosensitive member. At the position irradiated with light, pairs of electrons and holes are generated inside the photosensitive member. Either electrons or holes are combined with the electric charges (positive of negative charges) on the surface of the photosensitive member that is to be neutralized. The remaining holes or electrons propagate through a photoconductive layer and reach a conductive substrate. Thus, a latent electrostatic image is formed on the surface of the photosensitive member by electric charges which are not neutralized. Toner (black powder) charged to a polarity opposite that of the charges on the surface of the photosensitive member is supplied onto the surface thereof and is attracted by Coulomb attraction so as to form a toner image. In this case, the potential of the developing unit is set by slightly higher than that of the photosensitive member so that an electric field opposite to that of the charges is formed between the photosensitive member and the developing unit and a developing bias is applied thereto. For this reason, if the surface of the photosensitive member is not charged, the toner cannot be attracted to the photosensitive member by the charge of the toner itself.

The following characteristics are required of a photosensitive member.

( 1) Electric charges on the surface of the photosensitive member must be carried on the surface until light is radiated.

(2) One of a paired electron and hole neutralizes the electric charge on the surface of the photosensitive member without recombination, and the remaining hole or electron reaches the conductive substrate of the photosensitive member in a short period of time.

In the electrophotographic photosensitive member having such requirments, an amorphous chalcogenide material is conventionally used for a photoconductive member. The photoconductive member formed of the material can be fabricated to have a large area. However, since the material absorbs light varying from visible light to ultraviolet light, photosensitivity in the visible light region is practically low. Because amorphous chalcogenide is insufficiently hard, it has a short lifetime.

Recently amorphous silicon (to be referred to as a-Si hereinafter) has been attracting much attention as a photoconductive material. The a-Si has a wide absorption wave range, is panchromatic, and is very hard. When the A-Si is applied to a photosensitive member it has a lifetime 10 times that of a conventional photosensitive member. Furthermore, the A-Si is not toxic. In addition, since the a-Si is inexpensive, a photosensitive member of a large area can be easily achieved as compared to one composed of, say, single crystalline silicon.

However, since the a-Si normally has a resistivity of about $10^8$ to $10^{10}$ $\Omega$·cm in a dark condition (can simply be called a "dark resistivity"), electric charges on a surface of a photosensitive member where a latent image is to be formed, cannot be held. In a photosensitive member an attempt is made such that an insulative layer (blocking layer) having a high resistivity such as silicon oxide, silicon carbide, silicon nitride and the like is interposed between the a-Si photoconductive layer and a substrate so that carriers are prevented from being injected into the photoconductive layer from the conductive substrate. In this case, however, when the thickness of the high resistivity (blocking layer) insulative layer is increased, transmission of carriers from the a-Si layer, formed on the insulative layer, to the conductive substrate is interrupted, thus causing a residual potential. On the other hand, when the thickness of the insulative layer is decreased, a sufficient potential holding function cannot be provided.

Meanwhile, a method has been proposed in which a semiconductor film having a p- or n-type conductivity is interposed between a conductive substrate and a photoconductive layer. Normally, a-Si in which B (boron) or P (phoshorus) is doped to a high concentration is used for this purpose. Such a layer is called a blocking layer. The charge blocking property of the blocking layer can be improved by doping it with a high concentration of B or P. However, such a layer has a high degree of internal stress. When a film having a different level of stress is stacked thereon, the film cannot be held and is easily removed.

Light absorption of a-Si occurs over a wide wavelength range, and absorbency is only gradually decreased, even near the absorption edge. That is, although absorbency is decreased within a wavelength range between 700 nm and 800 nm, it is not decreased to 0, thus permitting slight absorption of light. Therefore, when a photoconductive layer is formed of such a material and has so great a film thickness, as that found in a photosensitive member, light having a long wavelength may be absorbed by a portion near the base of the photoconductive layer. Since the electrons and holes of a-Si have low mobility, carriers generated away from the surface of the photosensitive member tend to remain in the a-Si layer. An electrophotography apparatus has a so-called discharging process wherein residual charges on the surface of the photosensitive member are erased after a transfer of an image is performed. When this process is performed by exposure, residual carriers inside the a-Si film neutralize surface charges formed on the photosensitive member in preparation for obtaining the next image. Therefore, the charging property after exposure is considerably degraded as compared to that in dark conditions.

SUMMARY OF THE INVENTION

It is an object of the present invention to provide a photoconductive member in which a residual potential is suppressed, a potential holding property and a charging property are improved. Degradation in the charging property after repeated charging, exposure and discharging is reduced, insulation breakdown due to a developing bias does not occur, and layers are not easily peeled.

A photoconductive member according to the present invention comprises:

a conductive substrate;

a first blocking layer formed on the conductive substrate, the first blocking layer being formed of amorphous silicon carbide or amorphous silicon nitride, and containing $1\times10^{-4}$ to 1.0 atomic % of an element of Group III or V of the Periodic Table;

a second blocking layer formed on the first blocking layer, the second blocking layer being formed of amorphous silicon carbide or amorphous silicon nitride, containing $1\times10^{-8}$ to $1\times10^{-4}$ atomic % of an element of Group III or V of the Periodic Table, and having a thickness of 5 μm to 40 μm; and a photoconductive layer formed on the second blocking layer, the photoconductive layer being formed of amorphous silicon and having a thickness of 0.5 μm to 5 μm.

Another photoconductive member according to the present invention comprises:

a conductive substrate;

a blocking layer formed on the conductive substrate, the blocking layer being formed of amorphous silicon carbide or amorphous silicon nitride and containing $1\times10^{-3}$ to 1.0 atomic % of an element of Group III or V of the Periodic Table;

a first photoconductive layer formed on the blocking layer, the first photoconductive layer being formed of amorphous silicon carbide or amorphous silicon nitride, containing $1\times10^{-6}$ to $1\times10^{-3}$ atomic % of an element of Group III of the Periodic Table, and the produce of the mobility ($cm^2$/sec V) and the lifetime (sec) of the holes in electron-hole pairs generated upon light absorption being $1\times10-7$ $cm^2$/V or higher; and a second photoconductive layer formed on the first photoconductive layer, the second photoconductive layer being formed of amorphous silicon, having a thickness of 0.1 μm to 5 μm, and containing $1\times10^{-6}$ to $1\times10^{-3}$ atomic % of an element of Group III of the Periodic Table.

According to the present invention, in the first layer (the first blocking layer or the blocking layer) formed on the conductive substrate, at least one of the elements of Group III or V of the Periodic Table is relatively heavily doped, and the first layer is either a p- or an n-type semiconductor layer. In the second layer (the second blocking layer or the first photoconductive layer) formed on the first layer, at least one of the elements of Group III Or V of the Periodic Table is lightly doped, and the second layer is an intrinsic (i-type) semiconductor layer. A third layer (the photoconductive layer or the second photoconductive layer) is formed on the second l ayer. With this structure, a photoconductive layer has improved potential holding and charging properties and is free from residual potential, and insulation breakdown due to a developing bias that can be prevented. According to the present invention, layer removal can be prevented and degradation in the charging property can be suppressed even after repeated exposure and discharging.

DETAILED DESCRIPTION OF THE PREFERRED EMBODIMENTS

A first embodiment of the present invention will be described with reference to FIG. 1.

Figure 1:
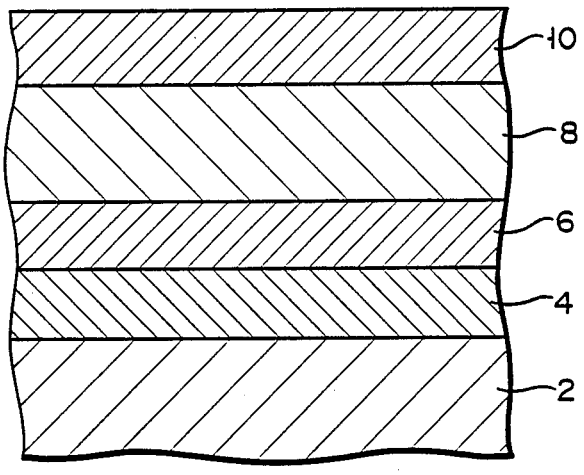
FIG. 1 is a partial sectional view of a photoconductive member according to a first embodiment of the present invention.

Referring to FIG. 1, reference numeral 2 denotes a flat- or drum-shaped conductive carrier (e.g., an aluminum drum). A first blocking layer 4 is stacked on the conductive substrate 2. The layer 4 comprises amorphous silicon nitride (to be referrred to as a-Si:N hereinafter) or amorphous silicon carbide (to be referred to as a-Si:C hereinafter) containing $1\times10^{-4}$ atomic % to 1.0 atomic % of a Group III Or V element in the Periodic Table. The layer 4 improves the potential holding and charging properties of a surface of a photoconductive member by preventing carriers from flowing into a photoconductive layer 8 from the substrate 2.

A second blocking layer 6 is stacked on the layer 4 and has a thickness of 5 μm to 40 μm. The layer 6 comprises a-Si:N or a-Si:C containing $1\times10^{-8}$ atomic % to $1\times10^{-4}$ atomic % of Group III or V element in the Periodic Table. The layer 6 has a slightly wider optical band gap and a higher resisitivity than the layer 4. The thickness of the layer 6 must be changed in accordance with the surface potential charge used.

The photoconductive layer 8 is stacked on the layer 6 and has a thickness of 0.5 μm to 5 μm. The layer 8 comprises amorphous silicon (to be referred to as a-Si hereinafter) containing either a Group IIIa or Va element in the Periodic Table within the range between $1\times10^{-8}$ atomic % and $1\times10^{-4}$ atomic %. The a-Si has a high absorption coefficient over a wide wavelength range, and, because of its given thickness, a sufficient photosensitivity can be obtained.

In order to improve the chemical stability, a surface coating layer 10 having a resistivity of $10^{18}$ Ω·cm or higher is preferably stacked on the layer 8 so as to give it a thickness of 0.05 μm to 5 μm. A material having a wide optical band gap such as $Si0_2$, SiN, SiC or the like is preferably used for the layer 10. In addition, in order to enhance the mobility of electrons, a group IIIa element in the Periodic Table is preferably doped in the layer 10.

The layer 6 plays an auxiliary role to the layer 4, and has a slightly wider optical band gap and a higher resistivity than the layer 4, as described above. The layer 4 is subjected to relatively heavy doping, and is a p- or n-type semiconductor layer. In contrast to this, the layer 6 is subjected to a light doping, and is an i-type (intrinsic) semiconductor layer. With this double-layered structure, charging and potential holding properties can be improved.

A second embodiment of the present invention will be described with reference to FIG. 2.

Figure 2:
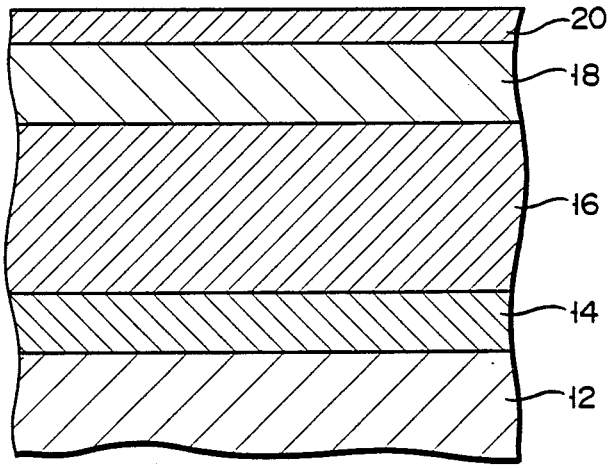
FIG. 2 is a partial sectional view of a photoconductive member according to a second embodiment of the present invention.

FIG. 2 shows a photoconductive member (e.g., a photosensitive member), and reference numeral 12 denotes a flat- or drum-shaped conductive carrier.

A blocking layer 14 is stacked on the substrate 12 and comprises a-Si:N or a-Si:C containing a Group III or V element in an amount falling within the range betwwen $1.0\times10^{-4}$ atomic % and 1.0 atomic %.

A first photoconductive layer 16 is stacked on the layer 14 and has a thickness of 5 μm to 60 μm, and comprises a-Si:N or a-Si:C containing a Group III element in an amount falling within the range between $1.0\times10^{-8}$ atomic % and $1.0\times10^{-4}$ atomic %. The thickness of the layer 16 can be 5 μm but is changed in accordance with the desired surface potential when a surface thereof is to be charged. Characteristics required for the layer 16 are as follows: a nitrogen content in the layer must be 0.1 atomic % to 15 atomic % with respect to the silicon content; an optical band gap preferably falls within the range between 1.65 eV and 1.9 eV; and the product $\mu\cdot\tau$ of the mobility $\mu$ and the lifetime $\tau$ of the holes in electron-hole pairs generated by light absorption is set to be $1\times10^{-7}$ cm$^2$/V or higher. In this case, it is particularily important that the mobility $\mu$ be high. When a low-mobility portion is present in other than a surface layer in the amorphous layer constituting the photosensitive member, quick movement of carriers, generated by light absorption, toward the substrate 12 is interfered with, resulting in degradation in repeating characteristics and the like. Therefore, since a-Si:N, a-Si:C or a-Si has a high mobility of electrons but a relatively low mobility of holes, materials must be selected in consideration of the stated characteristics.

Furthermore, a second photoconductive layer 18 is stacked on the layer 16 and has a thickness of 0.5 μm to 5 μm. The layer 10 comprises a-Si containing an element of Group III of the Periodic Table within the range between $1\times10^{-8}$ atomic % and $1.0\times10^{-4}$ atomic %. This a-Si has a high ligth absorption coefficient within a wide wavelength range, and a sufficient photosensitivity can be obtained within the thickness range described above.

A surface coating layer 20 is stacked on the layer 18 and has a thickness of 500 Å to 5 μm in order to improve chemical stability. A material having a wide optical band gap such as $Si0_2$, SiN, SiC or the like is preferably used for the layer 20. In addition, in order to enhance the mobility of electrons, light doping of an element of Group III in the Periodic Table is effective.

With the above structure, since the layer 14 comprises a-Si:N or a-Si:C containing an element of Group III or V in an amount falling within the range between $1\times10^{-4}$ atomic % and 1.0 atomic %, the films can be prevented from being removed.

The photoconductive layers are comprised of the first and second photoconductive layers 16 and 18. The layer 16 comprises a-Si:N or a-Si:C containing $1\times10^{-8}$ atomic % to $1\times10^{-4}$ atomic % of a Group III element, has a product $\mu\cdot\tau$ of a mobility $\mu$ and a lifetime $\tau$ of holes in electron-hole pairs, generated by light absorption, of $1\times10^{-7}$ cm$^2$/V or higher, and has a thickness of 5 μm to 60 μm. The layer 18 comprises a-Si containing $1\times10^{8}$ atomic % to $1.0\times10^{-4}$ atomic % of a group III element, and has a thickness of 0.5 μm to 5 μm. Therefore, good charging and potential holding properties can be achieved, and an undesirable decrease in the charging property due to exposure immediately before charging is suppressed.

When the layers 16 and 18 comprise different materials, and when a material having a small optical band gap is used for the layer 18 adjacent to the surface, light absorption occurs mainly in the layer 18. When the film thickness of the layer 18 is set at about 5 μm, carriers generated by exposure do not remain in the layer. Therefore, a decrease in the charging property due to exposure immediately before charging, or degradation in the charging property after repeated exposure and discharging steps is further suppressed.

The layer 16 at the side of the layer 14 comprises preferably a-SiN or a-Si:C having an optical band gap of 1.7 eV to 2.0 eV. In addition, when B or P is slightly doped in the layer 16 the mobility of holes can be further enhanced.

Figure 3:
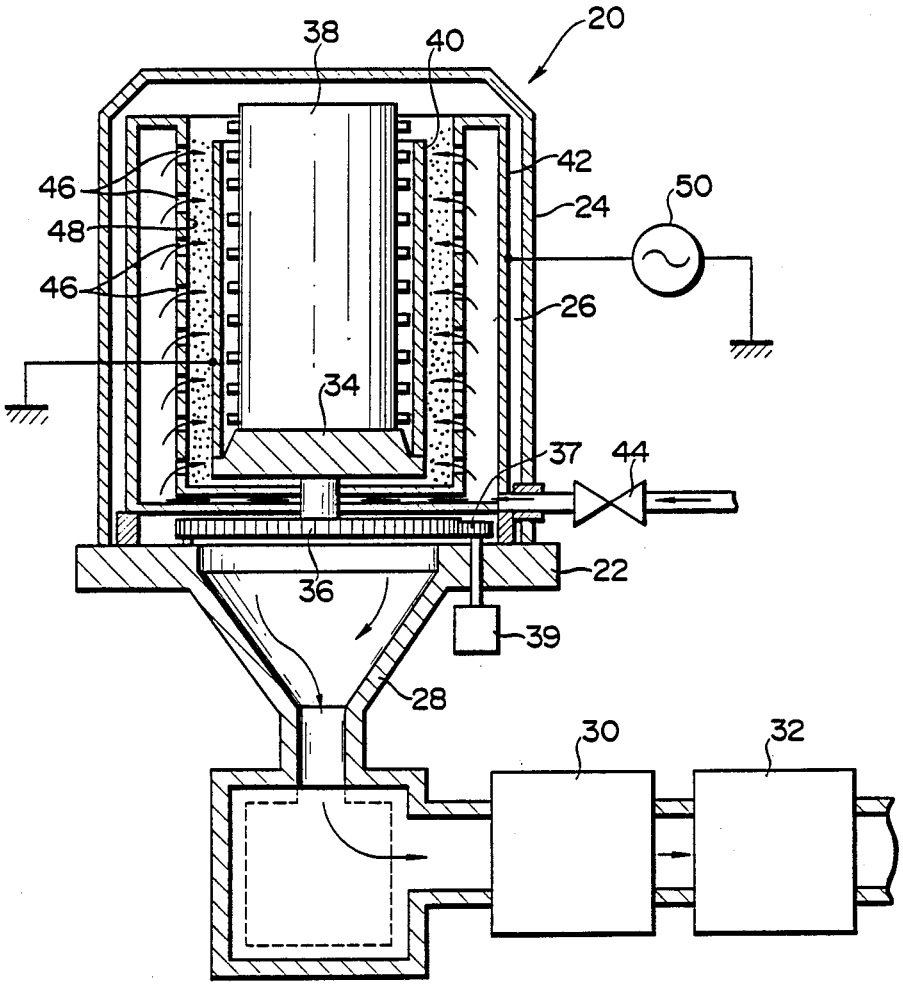
FIG. 3 is an illustration showing an apparatus for manufacturing the photoconductive member.

FIG. 3 shows an apparatus 20 for manufacturing a photosensitive member according to the present invention. An airtight housing 24 is provided on the base 22 of the apparatus 20, and a reaction chamber 26 is formed inside the housing 24. The base 22 communicates with a mechanical booster pump 30 and a rotary pump 32 through a pipe-like communication member 28. The reaction chamber 26 is evacuated to a pressure of $10^{-3}$ to $10^{-4}$ Torr by the pumps 30 and 32. A gear 36 is mounted on a lower surface of a drum holding member 34, and the member 34 is held on the base 22 through the gear 36 in such a fashion that it is rotatable about the center of the gear 36. A motor 39 is grounded through the base 22, and a gear 37 is fixed to a rotating shaft of the motor 39. The gear 37 is meshed with the gear 36. Upon rotation of the motor 39, a drum substrate 40, the member 34 and a heater 38 are rotated by the gears 36 and 37. The heater 38 is disposed at a central portion of the member 34, and the cylindrical conductive drum substrate 40 is provided on the member 34 so as to surround the heater 38. A cylindrical gas introduction member 42 having an outer and an inner wall is installed on the base 22 so as to surround the substrate 40, and the inner space between the outer and the inner walls of the member 42 communicates with an external gas supply source (not shown) through a valve 44. A plurality of gas outlet holes 46 are formed in the inner circumferential wall of the member 42. Therefore, a gas introduced into the member 42 through the valve 44 is emitted between the member 42 and the substrate 40 through the holes 45. Note that the substrate 40 is grounded. The inner wall of the member 42 serves as an electrode 48 which is connected to a high-frequency power source 50.

According to the apparatus with the above arrangement, the housing 24 is removed from the base 22 and the substrate 40 is placed on the member 34. Then, the housing 24 is air-tightly provided on the base 22 and the chamber 26 is evacuated to a pressure of $10^{-3}$ to $10^{-4}$ Torr by the pump 32. The substrate 40 is heated to 150° to 300° C. The evacuation system of the chamber 26 is switched from the pump 32 to the pump 30, and, at the same time, the valve 44 is opened, thereby supplying a feed gas to the chamber 26. For the feed gas, a gas containing silicon atoms, e.g., $SiH_4$ gas, $Si_2H_6$ gas or $SiF_4$ gas can be used. The feed gas is discharged toward the substrate 40 from the holes 46, and is evacuated by the pump 30. In this case, when the outputs from the valve 44 and the pump 30 are controlled, the feed gas in the chamber 26 is adjusted to a pressure of 0.1 to 1 Torr. The substrate 40 is rotated by the motor 39 and high-frequency power, e.g., 3.56 MHz power is applied to the electrode 48. Thus, a glow discharge is generated between the electrode 48 and the substrate 40 in the feed gas atmosphere. When the feed gas is continuously supplied, respective layers comprising a-Si as shown in FIGS. 1 and 2 are formed on he substrate 40. When an impurity element is doped, a gas containing atoms of the element to be doped can be supplied to the chamber 26 at the same time as the feed gas containing Si is supplied to the chamber 26. When an a-Si:N layer is formed, a gas containing N such as $N_2$, $NH_3$ and the like is mixed with the feed gas. When the a-Si:C film is formed, hydrocarbon such as $CH_4$, $C_2H_6$, and the like is mixed with the above gas mixture. When the mixing ratio of the gases is changed, the optical band gap can also be changed. In order to dope a Group III or V element in the Periodice Table, a gas such as $B_2H_6$ or $BF_3$, or a gas such as $PH_3$, $PF_5$ and the like can be mixed with the gas containing silicon atoms. Note that when a Group III or V element in the Periodic Table is doped, valence electron control of a-Si can be performed. In this case, it shows a smaller resistivity when a heavy doping is effected with the element of Group II or Group V and a greater resistivity when a light doping is effected with the element of Group III.

The present invention will be described by way of examples. An example of the first embodiment will be described first. For the first blocking layer 4, an a-Si:N or a-Si:C layer doped with $1\times10^{-3}$ atomic % of B was stacked on the substrate 2 to a thickness of about 0.5 μm. The layer 4 is subjected to heavy doping of B, and has low resistivity and an optical band gap of about 1.70 eV.

For the second blocking layer 6, an a-Si:N or a-Si:C layer doped with about $1\times10^{-6}$ atomic % of B was stacked to a thickness of 25 μm. Duye to B doping the layer is similar to an intrinsic region. The layer has a high resistivity of, e.g., $10^{13}$ Ω·cm, and an optical band gap of about 1.75 eV, which is wider than that of the layer 4.

For the photoconductive layer 8, an a-Si layer having a thickness of 5 μm was stacked. The layer need not be subjected to doping. However, when it is doped with about $1\times10^{-6}$ pf B, the mobility of holes is enhanced. The layer has an optical band gap of about 1.55 eV, and absorbs light over a wide wavelength range.

For the surface coating layer 10, an a-Si:N or a-Si:C layer having an optical band gap of 2.2 eV and a resistivity of about $10^{14}$ Ω·cm was stacked to a thickness of 1 μm. The thicness of the layer can be about 0.1 μm. When the thickness of the layer is set at 5 μm or less, the residual potential is slightly increased. However, because the charging property in drak conditions can be improved sufficiently, this disadvantage can be overcome and the film can be chemically stabilized. When it is doped with about $1\times10^{-6}$ atomic % of B, the mobility of electrons is enhanced.

When the photoconductive member manufactured in the above manner was used as the photosensitive member, excellent electrostatic characteristics were obtained. That is, a surface potential of 700 V or higher was obtained at a current of 0.4 μc/cm$^2$, flowing into the photosentitive member from a corona charger, and the potential holding rate within 15 seconds after charging was 80%.

Note that the photoconductive member is to be applied to a photosensitive member to be positively charged. when, however, the dopant B(Boron) is replaced with P(phosphorus), the member can be applied to a photosensitive member to be negatively charged. That is, the $B_2H_6$ gas to be mixed with the gas containing silicon atoms in the layer formation step can simply be replaced with $PH_3$, while the other conditions remain as described above. The photoconductive member manufactured in this manner had good charging and potential holding properties under the same conditions as described above, except that the polarity of the voltage applied to the corona charger was reversed.

An example of the second embodiment will be described. For the blocking layer 14, an a-Si:N or a-Si:C layer doped with $1\times10^{-3}$ atomic % of B was stacked to a thickness of about 0.5 μm. The layer 14 is subjected to a heavy doping of B, and has low resistivity and an optical band gap of about 1.70 eV.

For the first photoconductive layer 16, an a-Si:N or a-Si:C layer doped with $1\times10^{-6}$ atomic % of B was stacked to a thickness of about 25 μm. Since the layer 16 is subjected to a light doping of B, it is similar to an intrinsic region. The layer 16 has a high resistivity of $10^{13}$ Ω·cm or greater, and has an optical band gap of about 1.75 eV, which is wider than that of the layer 18.

For the second photoconductive layer 18, an a-Si layer was stacked so as to have a thickness of about 5 μm. The ayer 18 need not be subjected to doping. However, when about $1\times10^{-6}$ atomic % of B is doped into the layer 18, the mobility of holes is enhanced. The layer 18 has an optical band gap width of about 1.55 eV and can absorb light over a wide wavelength range.

For the surface coating layer 20, an a-Si:N or a-Si:C layer having an optical band gap of about 2.2 eV and a resistivity of about $10^{14}$ Ω·cm was stacked to a thickness of 1 μm. The thickness of the layer 20 can be about 0.1 μm. However, when the thickness of the layer 20 is set to be 5 μm or less, although the residual potential is slightly increased, the charging property in dark conditions can be improved sufficiently to overcome this disadvantage, and the layer can be chemically stabilized. when the layer is doped with about $1\times10^{-6}$ atomic % of B, the mobility of electrons is enhanced.

When the photoconductive member manufactured in the above manner was used as a photosensitive member, excellent electrostatic characteristics could be obtained. That is, a surface potential of 700 V or higher was obtained at a current of 0.4 μc/cm$^2$, flowing into the photosensitive member from a corona charger, and the potential holding rate within 15 seconds after charging was 80%. In addition, layers were not easily removed, and the decrease in the charging property was slight.

Note that the photoconductive member was applied to a photosensitive member to be positively charged. When, however, the dopant B is replaced with P, the photoconductive member can be applied to a negatively charged photosensitive member. That is, the $B_2H_6$ gas to be mixed with the gas containing Si atoms in the film formation step can be replaced with $PH_3$ gas, while the other conditions remain as described above. When the photoconductive member manufactured in this manner was used under the same conditions as described previously, except that the polarity of the voltage applied to the corona charger was changed, excellent charging and potential holding properties were achieved.

What is claimed is:

1. A photoconductive member comprising:

a conductive substrate;

a blocking layer disposed on said conductive substrate, said blocking layer comprising amorphous silicon carbide or amorphous silicon nitride and containing $1\times10^{-3}$ to 1.0 atomic % of an element of Group III or V of the Periodic Table;

a first photoconductive layer disposed on said blocking layer, said first photoconductive layer comprising amorphous silicon carbide or amorphous silicon nitride, containing $1\times10^{-6}$ to $1\times10^{-3}$ atomic % of an element of Group III Of the Periodic Table, and the product of the mobility ($cm^2$/sec V) and the lifetime (sec) of the holes in electron-hole pairs generated in light absorption being $1\times10^{-7}$ $cm^2$/V or higher;

a second photoconductive layer disposed on said first photoconductive layer, said second photoconductive layer comprising amorphous silicon, having a thickness of 0.1 μm to 5 μm, and containing $1\times10^{-6}$ to $1\times10^{-3}$ atomic % of an element of Group III of the Periodic Table; and a surface layer disposed on said second photoconductive layer, said surface layer having a thickness of 0.05 to 5 μm and a resistivity of $10^{13}$ Ω·cm.

2. A photoconductive member according to claim 1, wherein said element of Group III of the Periodic Table is B, and said element of Group V of the Periodic Table is P.

3. A photoconductive member according to claim 1, wherein said surface layer includes at least one of $SiO_2$, SiN, and SiC.

4. A photoconductive member according to claim 3, wherein said surface layer is doped with an element of Group III of the Periodic Table.

5. A photoconductive member according to claim 4, wherein said element of Group III of the Periodic Table is B.

* * * * *

UNITED STATES PATENT AND TRADEMARK OFFICE

CERTIFICATE OF CORRECTION

PATENT NO. : 4,716,089

DATED : Dec. 29, 1987

INVENTOR(S) : YAMAZAKI

It is certified that error appears in the above-identified patent and that said Letters Patent is hereby corrected as shown below:

TITLE PAGE:

Item [62], "abandoned" should read -- Pat. No. 4,666,803 --.

Signed and Sealed this

Twelfth Day of July, 1988

*Attest:*

*Attesting Officer*

DONALD J. QUIGG

*Commissioner of Patents and Trademarks*